US005757128A

United States Patent [19]

Topp

[11] Patent Number: 5,757,128

[45] Date of Patent: *May 26, 1998

[54] ADDRESSABLE ELECTROLUMINESCENT DISPLAY PANEL HAVING A SUBSTANTIALLY CONTINUOUS FOOTPRINT

[76] Inventor: Mark Topp, 4530 NW. 102 Ct., Miami, Fla. 33178

[ * ] Notice: The term of this patent shall not extend beyond the expiration date of Pat. No. 5,504,390.

[21] Appl. No.: 615,543

[22] Filed: Mar. 11, 1996

Related U.S. Application Data

[63] Continuation-in-part of Ser. No. 205,513, Mar. 3, 1994, Pat. No. 5,504,390.

[51] Int. Cl.[6] ..... H01J 1/52

[52] U.S. Cl. ..... 313/509; 313/510; 315/169.3

[58] Field of Search ..... 313/503, 506, 313/505, 509, 510, 511, 494; 315/169.3

[56] References Cited

U.S. PATENT DOCUMENTS

| | | | |
|---|---|---|---|
| 3,219,865 | 11/1965 | Vodicka | 313/509 |
| 3,225,253 | 12/1965 | Narken et al. | 315/150 |
| 3,544,990 | 12/1970 | MacIntyre | 313/494 |
| 4,665,342 | 5/1987 | Topp et al. | 313/505 |
| 4,752,717 | 6/1988 | Mental | 313/511 |
| 5,266,865 | 11/1993 | Haizumi | 313/506 |
| 5,504,390 | 4/1996 | Top | 313/509 |

*Primary Examiner*—Sandra L. O'Shea
*Assistant Examiner*—Michael Day
*Attorney, Agent, or Firm*—Michael J. Weins

[57] ABSTRACT

The present invention is directed to an addressable electroluminescent display which can minimize and in some cases eliminate ghost images resulting from leads used to energize the display. The addressable display has a polymer film substrate with a first electrode deposited onto the polymer film. A group electrode is provided which is spaced apart from the first electrode. The group electrode has segments so arranged that, when projected onto the first electrode, the segments form a substantially continuous group electrode footprint. A phosphor layer is interposed between the first electrode and the group electrode. Preferably, a dielectric layer is also interposed between the phosphor layer and the group electrode. A group electrode insulating layer overlies the group electrode and has group electrode lead passages therethrough. Group electrode leads overlay the group electrode insulating layer and are positioned such that their projection onto the first electrode lies within the group electrode footprint. The group electrode leads pass through the group electrode lead passages to connect with the group electrode. In a preferred embodiment, the group electrode has co-planar segments which provide the substantially continuous group electrode footprint.

6 Claims, 12 Drawing Sheets

ADDRESSABLE ELECTROLUMINESCENT DISPLAY PANEL HAVING A SUBSTANTIALLY CONTINUOUS FOOTPRINT

This application is a continuation in part of Ser. No. 205,513, filed Mar. 3, 1994, now U.S. Pat. No. 5,504,390.

FIELD OF THE INVENTION

The present invention relates to an electroluminescent device and, more particularly, to an addressable electroluminescent display which allows a phosphor layer to be selectively energized to generate lighted regions in the phosphor layer.

BACKGROUND OF THE INVENTION

Addressable displays have been available for many years. U.S. Pat. No. 3,631,286 teaches a display created by a sandwich stack of a first array of electrodes, a continuous layer of phosphor, and a second array of electrodes. When a potential is imposed across the phosphor layer by maintaining a pair of electrodes, one for each array at different potentials, light will be emitted from the phosphor layer therebetween. The electrodes of the second array are provided with openings through which the light emitted by the emitting phosphor layer is viewed. The electrodes of the second array have openings which are configured such that the peripheral edge length per unit cross sectional area of the opening enhances or otherwise takes advantage of the intensified fields which exist at the edge of conductors. Such a configuration provides a brighter glow in the regions of the phosphor layer so excited by the intensified fields. While this technique will provide a display with regions in which the phosphor will emit a high intensity glow, other regions of the phosphor will be dimly lit due to the background field created between the two arrays of electrodes. These residual non-zero fields create low intensity illumination or ghost images. Ghost images can also result from stray fields generated by the current in leads used to excite the electrodes if these fields pass through the phosphor layer.

The ghost images from stray fields from wiring have been addressed in the patents of Mark Topp et al, U.S. Pat. Nos. 4,614,668 and 4,665,342. These patents teach that if an array of discrete regions of phosphor is employed with an array of transparent electrodes, the wiring can be patterned to conform to the phosphor free regions and ghost images from the wiring can be eliminated.

Another approach to isolate the display pattern resulting from the application of a field is to configure the electrodes to the desired pattern. U.S. Pat. No. 4,904,901 teaches using shaped transparent electrodes configured to the shape to be displayed. This technique may produce haloes or ghost images about the edges of the electrodes. Also, stray fields introduced by the wiring may result in ghost images. Finally, the technique of the '901 patent limits the regions which can be illuminated.

OBJECTS OF THE INVENTION

It is an object of the invention to provide an electroluminescent display with either a continuous phosphor layer or a discontinuous phosphor layer over which conductive leads can be passed without creating ghost images from the leads.

It is another object of the invention to provide a display where the contrast of the image can be reversed.

It is another object of the invention to provide a display wherein there are no haloes.

It is another object of the invention to provide a display which can be readily fabricated by screen printing.

These and other objects of the invention will become apparent from the following description, drawings and claims.

SUMMARY OF THE INVENTION

The present invention is for an electroluminescent display which can be fabricated by screen printing. In the broadest sense, the present invention provides a first electrode spaced apart from a group electrode with a phosphor layer therebetween. The group electrode has segments so arranged that when projected onto the first electrode, they form a substantially continuous group electrode footprint. The term "continuous" as used herein shall consistently mean the dictionary definition of being connected. With such a definition of the term, a continuous footprint includes configurations having open regions therein. The term "substantially continuous" as used herein shall consistently mean continuous as defined above with the possible exception of narrow inter-segment gaps which separate the electrode segments, and thus separate the footprint which the group electrode projects into segments. Group electrode leads are provided for energizing individual segments of the group electrode and are positioned such that, when projected onto the first electrode, they fall onto the substantially continuous footprint of the segments of the group electrode. The segments can be energized to shield the phosphor layer from stray fields generated by the leads. In this way, by selectively energizing the segments which reside between the leads and the phosphor layer, any field generated between the leads and the first electrode can be suppressed, thereby assuring that no images result from the leads.

The electroluminescent display, in an elementary form, has a first electrode which is preferably transparent and fabricated from a material such as indium tin oxide. A phosphor layer is deposited onto the first electrode. Materials such as copper-activated or copper manganese-activated zinc sulfide are suitable for the phosphor layer. A dielectric layer with high resistance such as barium titanate is deposited onto the phosphor layer. A group electrode is provided which is spaced apart from the first electrode to accommodate the phosphor layer therebetween. The group electrode is segmented and has co-planar segments. The segments of the group electrode are so arranged that when projected onto the first electrode they form a substantially continuous group electrode footprint.

A group electrode insulating layer such as barium titanate overlays the group electrode. Group electrode leads are overlaid on the group electrode insulating layer and positioned such that they project onto the substantially continuous group electrode footprint. The group electrode insulating layer has group electrode lead passages therethrough for the passage of the group electrode leads so that they can be connected to the group electrode.

In a further preferred embodiment, the group electrode has a back electrode which is spaced apart from the co-planar segments. An intermediate insulating layer is interposed between the back electrode and the co-planar segments. Vias are provided which pass through the back electrode and the intermediate insulating layer. These vias extend the group electrode lead passages, allowing connection of the group electrode leads to the co-planar segments of the group electrode.

It is further preferred that the back electrode be electrically connected to the first electrode to shield the phosphor layer from the effects of the group electrode leads which lie behind the back electrode. The back electrode may be either a single section or may be made up of multiple sections which are connected to the first electrode.

BRIEF DESCRIPTION OF THE DRAWINGS

FIG. 5 also shows the regions between the co-planar segments where residual ghost images may occur.

FIG. 11 also illustrates a switch for changing the potential provided to the co-planar segments of the group electrode and to the first electrode.

BEST MODE OF CARRYING THE INVENTION INTO PRACTICE

Figure 1:
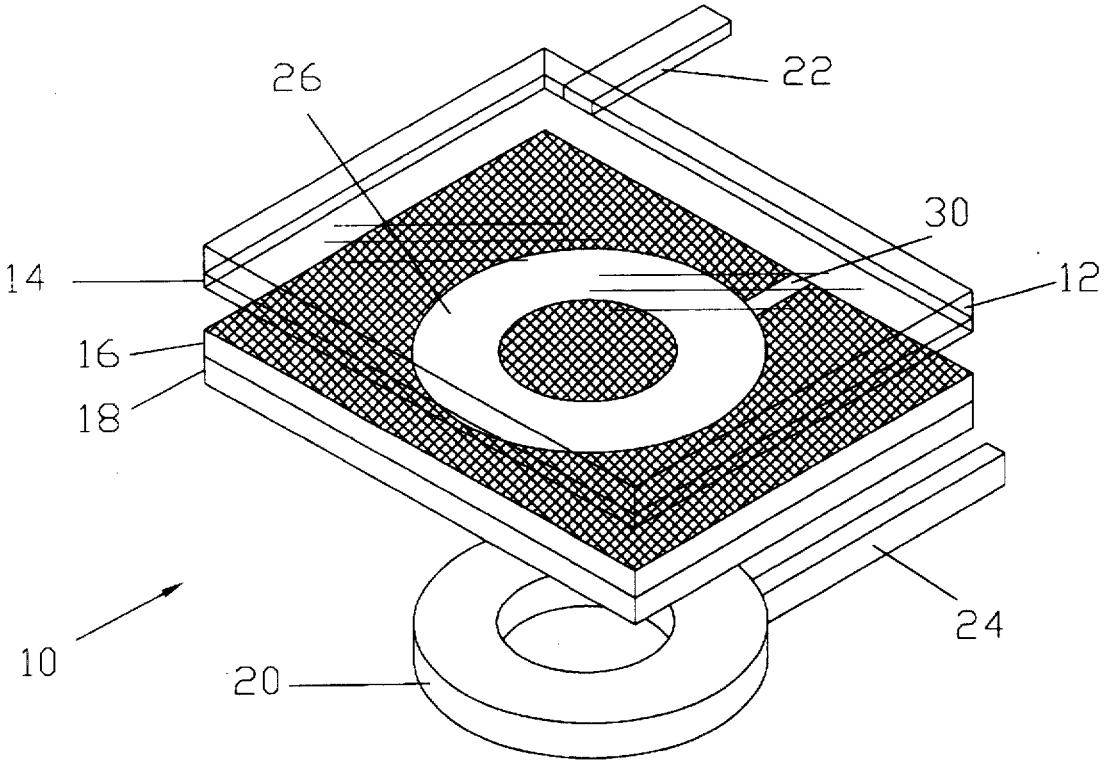
Figure 1 (Prior Art)
FIG. 1 is a partially exploded isometric view of a prior art electroluminescent display which provides a bright image of an O (bright field) on a dark background (dark field). A first electrode lead connects a first electrode, which is transparent, to a first potential. A second electrode lead connects an O-shaped second electrode to a second potential which differs from the potential of the first electrode, generating a field in the region between the second electrode and the first electrode. This field excites a phosphor layer therebetween and creates an image which can be seen through the first electrode. A ghost image results from excitation of the phosphor layer by the field generated between the second electrode lead, which is at the potential of the O-shaped second electrode, and the first electrode.

FIG. 1 is a partially exploded view of a prior art electroluminescent display 10 which is suitable for production by thick film technology. A polymer film with a transparent conductive layer, which is an integral part of the polymer film, is employed as the substrate for the electroluminescent display 10. Thereafter, the additional structural layers can be deposited by silk screening with appropriate inks to develop the overall structure. A polymer film 12, such as Mylar®, is employed as the substrate film. The substrate film includes a deposited layer forming a transparent conductive layer such as indium tin oxide which serves as a first electrode 14. Onto the first electrode 14 a phosphor layer 16, such as copper activated or copper manganese activated zinc sulfide, is deposited. An insulating layer 18 such as barium titanate is deposited onto the phosphor layer 16. A second electrode 20 is deposited onto the insulating layer 18.

A first electrode lead 22 establishes electrical contact with the first electrode 14 which is deposited on the polymer film 12. A second electrode lead 24 is attached to the second electrode 20. The second electrode lead 24 can be printed in the same operation as the printing of the second electrode 20. When a potential is maintained between the first electrode lead 22 and the second electrode lead 24, a field will be generated between the first electrode 14 and the second electrode 20. The field through the phosphor layer 16 will cause the phosphor layer 16 to emit light in a region 26 of the phosphor layer 16 making a visually bright field while leaving the remaining region of the phosphor layer 16 in dark field with the exception of a ghost image 30 which results from the stray field from the second electrode lead 24. The ghost image 30 may be quite unobtrusive and can be eliminated by masking with an opaque ink. However, as the lighting pattern becomes more complex, there will be additional ghost images and a ghost image pattern can result which will substantially detract from the display. Furthermore, if the image is masked with an opaque ink, the portion so masked will be visually non-responsive to the applied potential and will always remain dark. This limitation restricts the useful surface area of the display.

Figure 2:
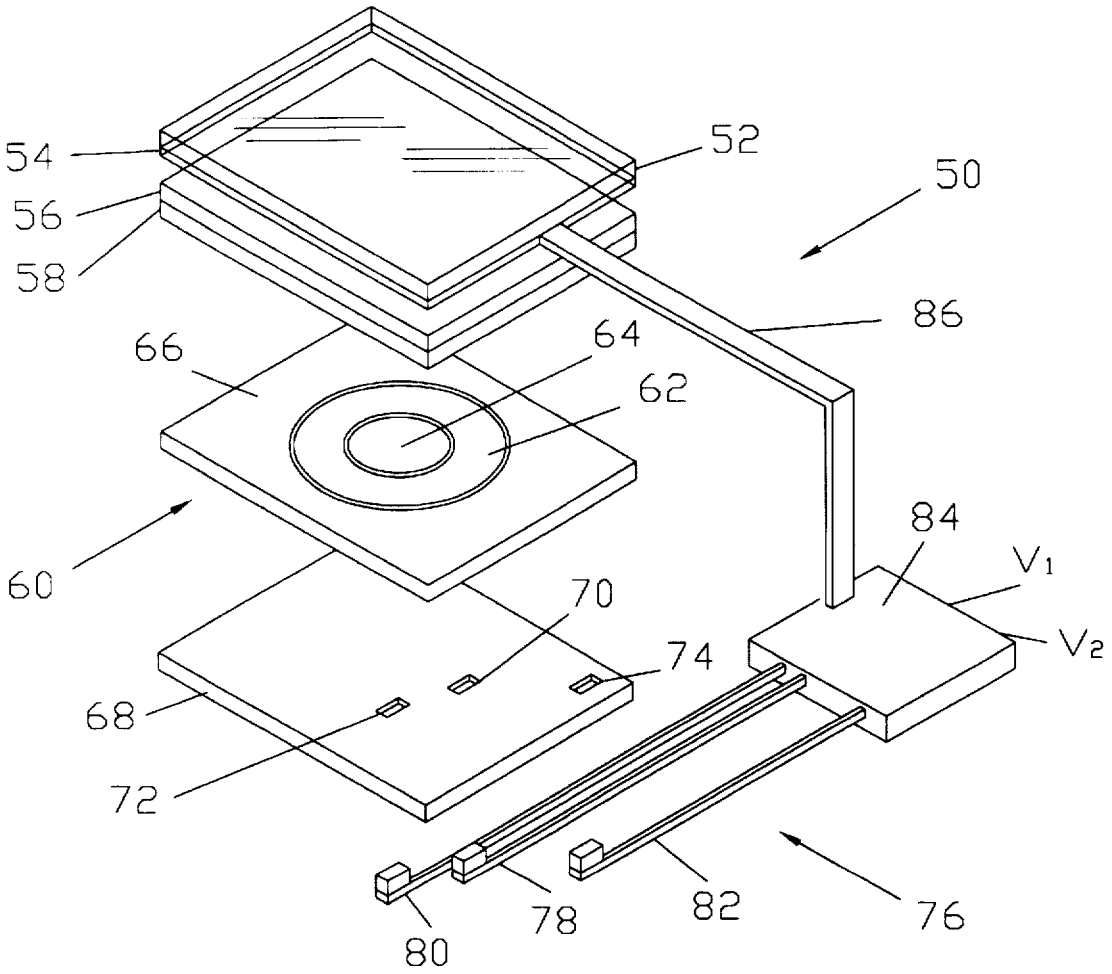
FIG. 2 is a partially exploded isometric view of an electroluminescent display of the present invention in which ghost images are significantly reduced. The display of FIG. 2 has a group electrode spaced apart from a first electrode which is transparent. The group electrode has multiple co-planar segments which are electrically isolated from each other but are in close proximity to each other such that when the co-planar segments are projected onto the first electrode they form a substantially continuous group electrode footprint. A first co-planar segment of the group electrode has an O shape, a second co-planar segment is internal to the first co-planar segment, and a third co-planar segment is external to the first co-planar segment. The three co-planar segments form a substantially continuous group electrode footprint which is rectangular.

FIG. 2 is a partially exploded isometric view of one embodiment of the present invention. In this embodiment, the electroluminescent display 50 will provide the bright field display of FIG. 1, and will provide the image without the associated ghost image 30 of the electroluminescent display 10 illustrated in FIG. 1. The elimination of the ghost image of the display 50 is accomplished without requiring masking of the display area with an opaque ink. In the display 50 of FIG. 2, a polymer film 52 is employed which has a transparent conductor such as indium tin oxide deposited thereon forming a first electrode 54. A phosphor layer 56 is deposited thereon. While the discussion will be in terms of a continuous phosphor layer, it should be appreciated that the benefit will also accrue to segmented phosphor layers. The phosphor layer 56, as discussed earlier, is an electroluminescent material such as copper-activated or copper manganese-activated zinc sulfate. An insulating layer 58 is deposited onto the phosphor layer 56.

The electroluminescent display 50 of the present invention illustrated in FIG. 2 differs from the prior art display 10 in that the display 50 employs a group electrode 60 in place of a single electrode. The group electrode 60 is spaced apart from the first electrode 54 and has a substantially continuous footprint covering the area of the display 50. The group electrode 60, for the embodiment of FIG. 2, has three co-planar segments which, when projected onto the first electrode 54, form a substantially continuous group electrode footprint covering the display region of the display 50. A first co-planar segment 62 is provided which is O shaped. A second co-planar segment 64 is surrounded by the first co-planar segment 62. A third co-planar segment 66 surrounds the first co-planar segment 62.

A group electrode insulating layer 68 overlays the group electrode 60. The group electrode insulating layer 68 has a first group electrode lead passage 70, a second group electrode lead passage 72 and a third group electrode lead passage 74 passing therethrough. The group electrode insulating layer 68 can be applied by silk screening barium titanate onto the group electrode 60. Overlaying the group electrode insulating layer 68 is a wiring layer 76 which has a first group electrode lead 78 which passes through the first group electrode lead passage 70 and connects to the first co-planar segment 62. The wiring layer 76 also has a second group electrode lead 80 which passes through the second group electrode lead passage 72 and connects to the second co-planar segment 64. A third group electrode lead 82 is provided in the wiring layer 76 which passes through the third group electrode lead passage 74 and connects to the third co-planar segment 66 of the group electrode 60. The wiring layer 76 can be readily printed with conductive ink and will project onto the substantially continuous group electrode footprint. A switching circuit 84 is connected to voltage sources $V_1$ and $V_2$ and to the group electrode leads 78, 80 and 82. A first electrode lead 86 is also connected to the switching circuit 84.

Figure 3:
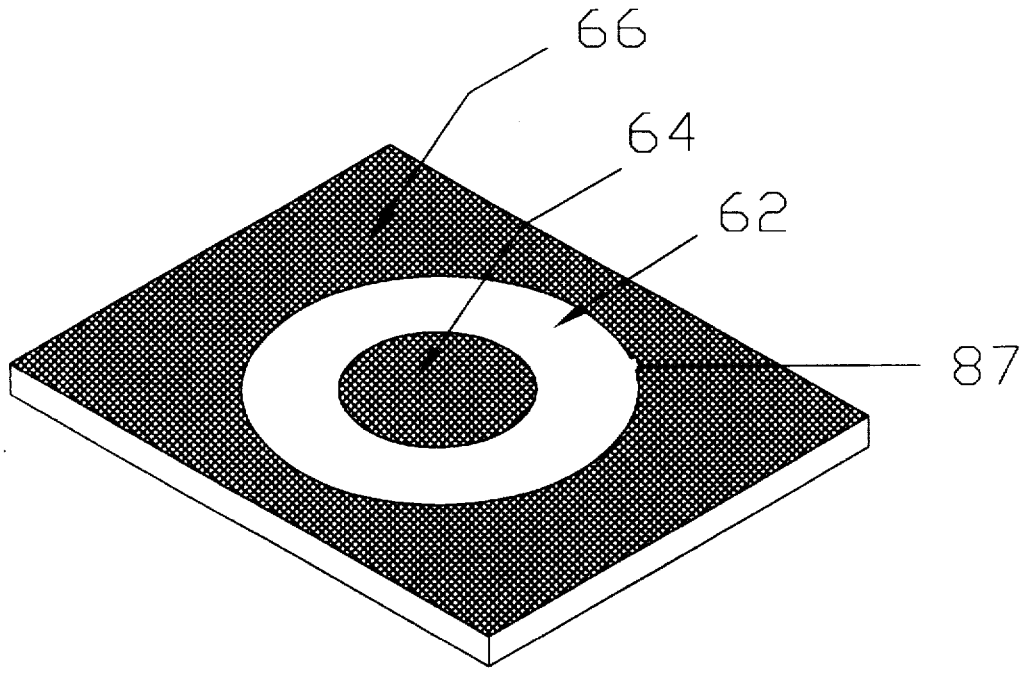
FIG. 3 illustrates the display of FIG. 2 where the first co-planar segment of the group electrode is maintained at a different potential from that of the first electrode, while the second co-planar segment and the third co-planar segment are maintained at the potential of the first electrode. Having the potential so distributed will generate a bright field O while the center of the O and the background maintain dark fields. The second and third co-planar segments of the group electrode, when maintained at the potential of the first electrode, assure that the dark field will have minimal residual ghost images resulting from the electrode leads connecting the O shaped electrode since the field associated with the electrical lead will be shielded by the co-planar segments which are maintained at the potential of the first electrode.

When the first electrode 54, the second co-planar segment 64, and the third co-planar segment 66 are at the same potential, different from that of the first co-planar segment 62, the lighting pattern of FIG. 3 results. In this case, the O is the bright field. The pattern of FIG. 3 is the same pattern provided by the prior art electroluminescent display 10; however, the image of FIG. 3 is free of ghost images, with the exception of a ghost image 87 which forms a small discontinuity in the peripheral edge of the O pattern. The cause of the discontinuity will be discussed in detail later with the aid of FIGS. 5 and 6.

Figure 4:
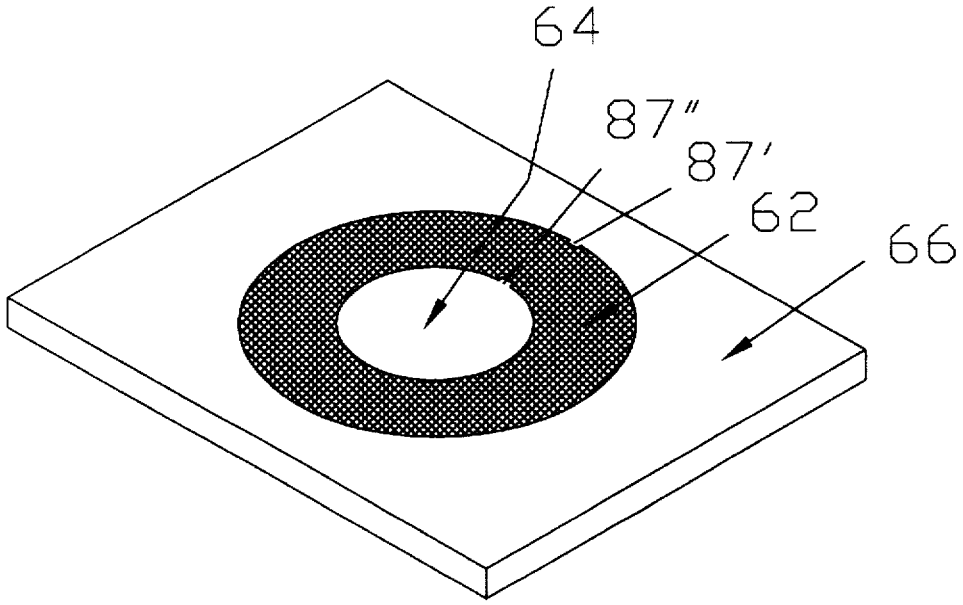
FIG. 4 illustrates the display that results from reversing the polarity of the three co-planar segments of the group electrode in which case the O shaped electrode is maintained at the potential of the first electrode making the O appear as a dark field while the other co-planar segments are maintained at a potential different than the first electrode to provide bright field images.

FIG. 4 illustrates the display that results from maintaining the first co-planar segment 62 at the potential of the first electrode 54 and the second co-planar segment 64 and the third co-planar segment 66 at a different potential. In this case, the O is the dark field. The ghost images are again avoided since the group electrode leads (78, 80 and 82) are behind the group electrode 60. With the group electrode leads (78, 80, and 82) so positioned, they are shielded by the group electrode 60 with the exception of small discontinuities in the peripheral of the O image providing ghost images 87' and 87". The cause of the discontinuity will be discussed later in conjunction with FIGS. 5 and 6.

Figure 5:
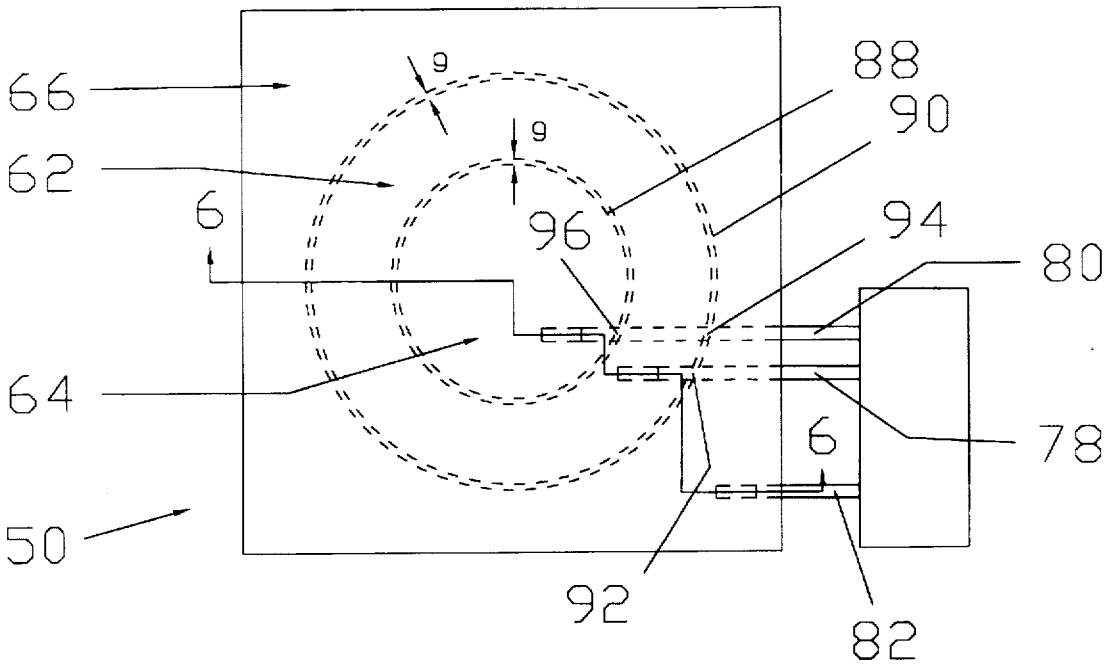
FIG. 5 is a top view of the structure of the display device of FIG. 2 illustrating the relative position of the various co-planar segments of the group electrode and the group electrode leads connecting the group electrode.
Figure 6:
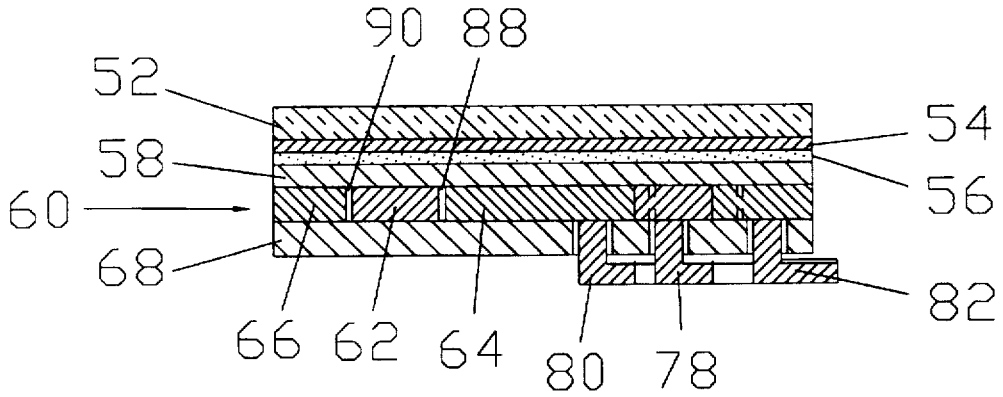
FIG. 6 is Section 6—6 of FIG. 5 illustrating the spacial relationship and the internal connection of the layers.

FIGS. 5 and 6 are additional views of the embodiment of FIG. 2 which show a top view of the display 50 and a section 6—6 of FIG. 5. FIGS. 5 and 6 illustrate the relative position of the three co-planar segments (62, 64 and 66) of the group electrode 60. The only lines of sight through the group electrode 60 are a first inter-segment gap 88 between the first co-planar segment 62 and the second co-planar segment 64 and a second inter-segment gap 90 between the first co-planar segment 62 and the third co-planar segment 66. As better shown in FIG. 5, the only locations where fields from the group electrical leads (78, 80, and 82) can pass through the phosphor layer 56 will be where the first group electrode lead 78 crosses the second inter-segment gap 90, generating a first line of sight 92, where the second group electrode lead 80 crosses the second inter-segment gap 90 generating a second line of sight 94, and where the second group electrode lead 80 crosses the first intersegment gap 88 generating a third line of sight 96. The size of these lines of sight (92, 94, and 96) will be dependent in part on the size of the width g of the inter-segment gaps (88 and 90).

Whether the lines of sight (92, 94, and 96) will generate images depends on the potential between the first electrode 54 and the group electrode leads (78, 80 and 82) as well as on the width g.

Referring again to FIGS. 3 and 5, when the first group electrode lead 78 is maintained at a different potential from the first electrode 54, as is the case when producing the image of FIG. 3, a field will be generated along the first line of sight 92 which produces a small discontinuity or residual ghost image 87 as illustrated in FIG. 3. When the second group electrode lead 80 is at the potential of the first electrode 54, as is the case when producing the display illustrated in FIG. 3, there will be no field generated and no discontinuities nor ghost images associated with the second group electrode lead.

Referring next to FIGS. 4 and 5, when the second group electrode lead 80 is maintained at a different potential from the first electrode 54, a field will be generated along the second and third lines of sight (94 and 96) producing ghost images 87' and 87" as illustrated in FIG. 4. Since the first group electrode lead 78 is at the potential of the first electrode 54 when the display in FIG. 4 is generated, there will be no field generated between the first group electrode lead 78 and the first electrode 54 and thus no ghost images will result along the first line of sight 92.

The intensity of these residual ghost images (87, 87' and 87") will be a function of the width g of the inter-segment gaps (88 and 90). It is preferred that the maximum width of the inter-segment gaps be less than 20 mils, since gaps as large as 20 mils are readily visible to the naked eye in daylight. More preferably, the maximum width should be less than about 10 mils so that residual ghost images (87, 87', and 87") will be visible only in dim light.

These residual ghost images (87, 87', and 87") can be eliminated by eliminating the lines of sight (92, 94, and 96). Distributing the group electrode 60 on vertically spaced apart layers would allow the segments (62, 64, and 66) to overlap without providing conductive paths between the segments of the group electrode 60.

Figure 7:
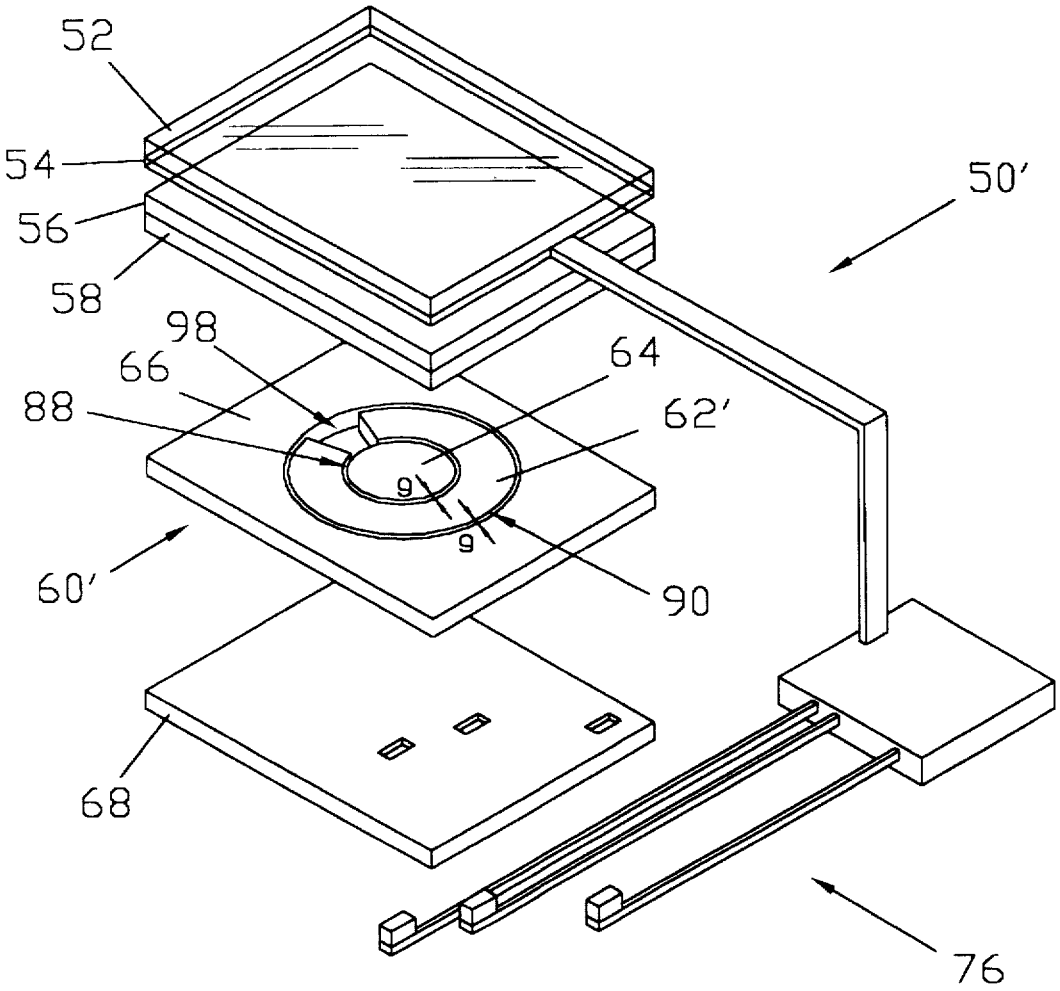
FIG. 7 is a partially exploded isometric view of a display which is similar to the display illustrated in FIG. 2. This display differs in the details of the group electrode and in particular the configuration of the co-planar segments. The co-planar segments project a footprint which is substantially continuous yet has an open region therein. The display of FIG. 7 will provide a bright field C or a dark field O.

FIG. 7 is another display 50' which is similar to the display 50 of FIG. 2. The difference between the two displays (50 and 50') is that the display 50' has a group electrode 60' with a first co-planar segment 62' which is C shaped rather than O shaped. This C shaped first co-planar segment 62' maintains continuity of the group electrode 60' since all segments of the group electrode 60' are connected. All other components are the same as for the display 50. The C shaped first co-planar segment 62' in combination with the second co-planar segment 64 and the third co-planar segment 66 form a substantially continuous group electrode which is connected with the exception of the intersegment gaps (88 and 90) of width g, g being preferably maintained at less than about 20 mils and more preferably less than 10 mils to preserve the substantially continuous character of the group electrode 60'. The group electrode 60' has an open region 98 providing a substantial line of sight through the group electrode 60'. As with the display 50, the wiring layer 76 is printed over the substantially continuous footprint of the group electrode 60' and is excluded from the open region 98 to prevent ghost images.

The lighting pattern formed by the group electrode 60' when the first electrode 54, the second co-planar segment 64, and the third co-planar segment 66 are at the same potential, different from that of the first co-planar segment 62', will provide a C in bright field.

Alternatively, when the first co-planar segment 62' is maintained at the same potential as the first electrode 54, different from that of the second and third co-planar segments (64 and 66), the display 50' will provide a bright field for the regions on the phosphor layer 56 onto which the second and third co-planar segments (64 and 66) project, forming a dark field O.

Figure 8:
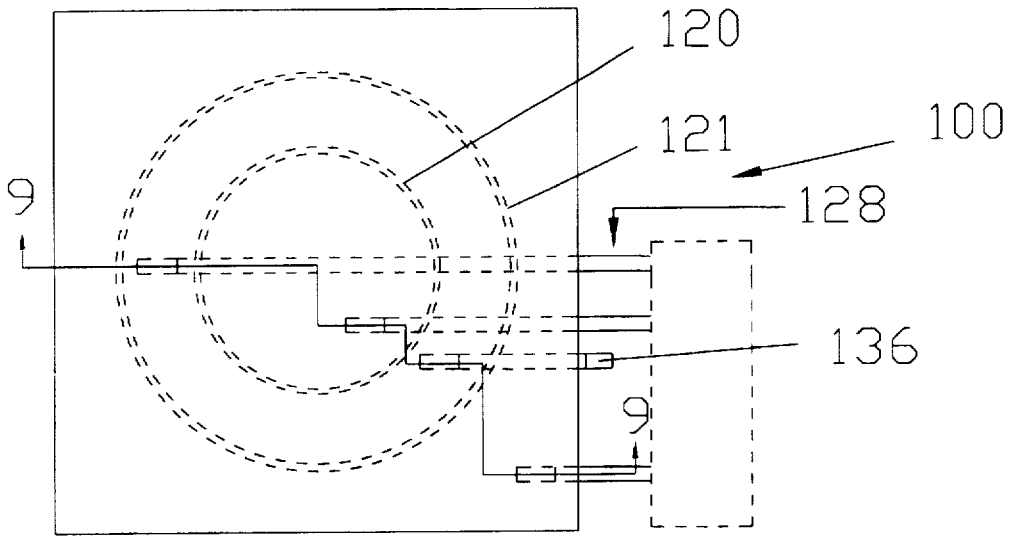
FIG. 8 is a top view of an alternate structure which will provide the same display as the device illustrated in FIGS. 2 and 5. This embodiment eliminates the residual ghost images associated with the embodiments illustrated in FIGS. 2 through 6. The residual ghost images are eliminated by the inclusion of a back electrode in the group electrode.
Figure 9:
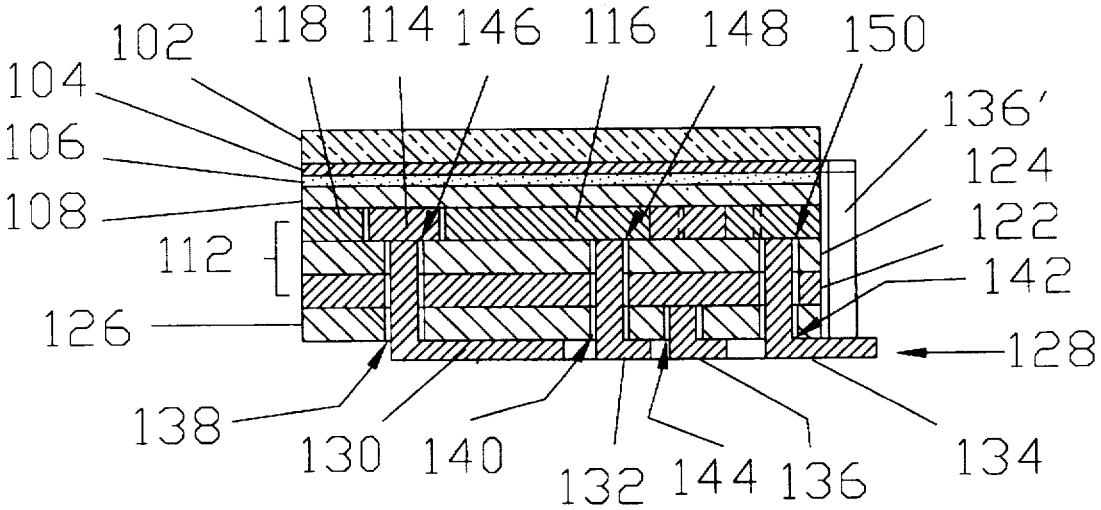
FIG. 9 is Section 9—9 of FIG. 8 illustrating the spacial relationship between the back electrode and the co-planar segments of the group electrode.

FIGS. 8 and 9 illustrate an electroluminescent display 100 which is an alternative to the embodiment illustrated in FIGS. 2–6. The display 100 has a group electrode, which in addition to having co-planar segments, has a back electrode which eliminates the lines of sight through the group electrode. The display of FIGS. 8 and 9 will provide the images similar to those of the display of FIG. 2. In this embodiment, the back electrode eliminates the ghost images inherent in the embodiment of FIG. 2 since there are no lines of sight through the group electrode.

Referring to FIG. 9, the display 100 has a polymer film substrate 102 having a first electrode 104 deposited thereon. The first electrode 104 is transparent. A phosphor layer 106 such as copper-activated or copper manganese-activated zinc sulfide is deposited onto the first electrode 104. A dielectric layer 108 such as barium titanate is deposited onto the phosphor layer 106.

A group electrode 112 is spaced apart from the first electrode 104 accommodating the phosphor layer 106 and the dielectric layer 108 therebetween. The group electrode 112 has a first co-planar segment 114, a second co-planar segment 116 and a third co-planar segment 118 which, when projected onto the first electrode 104, form a substantially continuous group electrode footprint having the cross section of the display. Since the first co-planar segment 114, the second co-planar segment 116 and the third co-planar segment 118 lie in the same plane, they can be screen printed in a single step onto the dielectric layer 108. As shown in FIG. 8, the group electrode resulting from such a screen print will leave inter-segment gaps 120 and 121 which provide two lines of sight through the group electrode formed by the three co-planar segments. A back electrode 122 is spaced apart from the first co-planar segment 114, the second co-planar segment 116 and the third co-planar segment 118. The back electrode 122 blocks the lines of sight through the inter-segment gaps 120 and 121 and, in combination with the co-planar segments (114, 116, and 118), provides a continuous group electrode footprint.

To maintain electrical isolation between the co-planar segments (114, 116, and 118) and the back electrode 122, an intermediate insulating layer 124 is interposed between the three co-planar segments (114, 116 and 118) and the back electrode 122. In this way, the substantially continuous group electrode footprint is converted to a continuous group electrode footprint assuring that the display will produce a ghost-free image.

A group electrode insulating layer 126 overlays the group electrode 112. A wiring layer 128 is provided and positioned such that its projection onto the first electrode 104 will fall within the substantially continuous group electrode footprint. The wiring layer 128 has a first group electrode lead 130 which connects to the first co-planar segment 114; a second group electrode lead 132 which connects to the second co-planar segment 116; a third group electrode lead 134 which connects to the third co-planar segment 118; and a fourth group electrode lead 136 which connects to the back electrode 122 and, via an extended lead 136', to the first electrode 104.

The group electrode insulating layer 126 is provided with group electrode lead passages (138, 140, 142 and 144). A first group electrode lead passage 138 accommodates the first group electrode lead 130. The first group electrode lead passage 138 is extended by a first group electrode lead via 146 which passes through the back electrode 122 and the intermediate insulating layer 124 allowing the first group electrode lead 130 to be connected to the first co-planar segment 114. A second group electrode lead passage 140 is extended by a second group electrode lead via 148, which passes through the back electrode 122 and the intermediate insulating layer 124 allowing the second group electrode lead 132 to be connected to the second co-planar segment 116. A third group electrode lead passage 142 is extended by a third group electrode lead via 150 which passes through the back electrode 122 and the intermediate insulating layer 124 allowing the third group electrode lead 134 to be connected to the third co-planar segment 118.

A back electrode lead passage 144, in the group electrode insulating layer 126, is provided which allows the fourth group electrode lead 136 to be connected to the back electrode 122. The fourth group electrode lead 136 is also connected to the first electrode 104 by the extended lead 136' assuring that any potential from the first group electrode lead 130 and the second group electrode lead 132 will be shielded by the back electrode 122, thereby avoiding ghost images.

Figure 10:
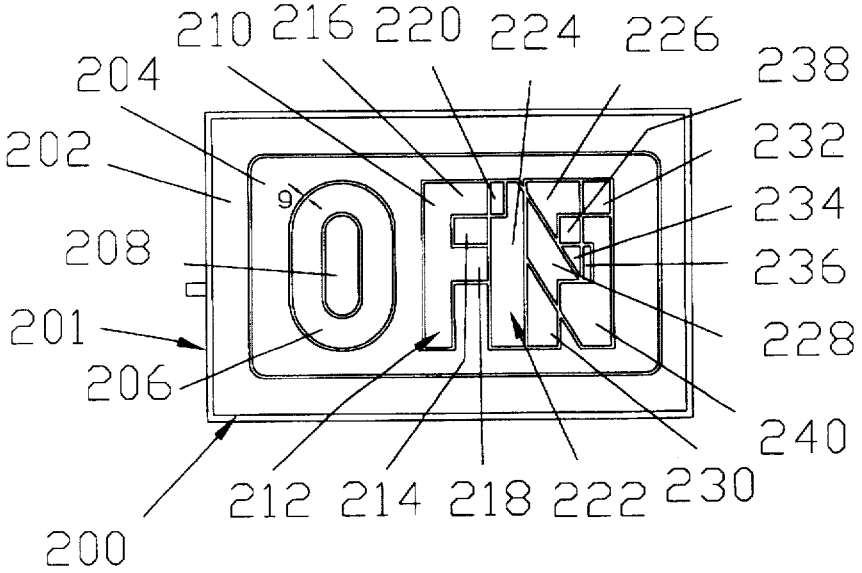
FIG. 10 is a plan view of a group electrode for another embodiment of the present invention which can display the words "ON" and "OFF". The group electrode is formed by sixteen co-planar segments which, when projected onto a first electrode, form a substantially continuous footprint.

While the above described embodiments of the invention have employed a group electrode with three co-planar segments, the number of co-planar segments can be readily changed. If more complex display patterns are desired, additional co-planar segments may be employed. FIG. 10 illustrates a group electrode 200 for a display which has sixteen co-planar segments. These co-planar segments are arranged such that their projection onto a first electrode 201 forms a substantially continuous footprint. The group electrode 200, when used in a display, will make it possible to provide multiple messages which can be generated at will. Such a display pattern can be fabricated, with the exception of the group electrode 200, having the same structural layers as illustrated in FIGS. 2 through 9. Additional group electrode leads and group electrode lead passages will be needed to accommodate the additional group electrode segments. In the event that the group electrode 200 has a back electrode and an intermediate insulating layer, additional vias will also be required.

Figure 11:
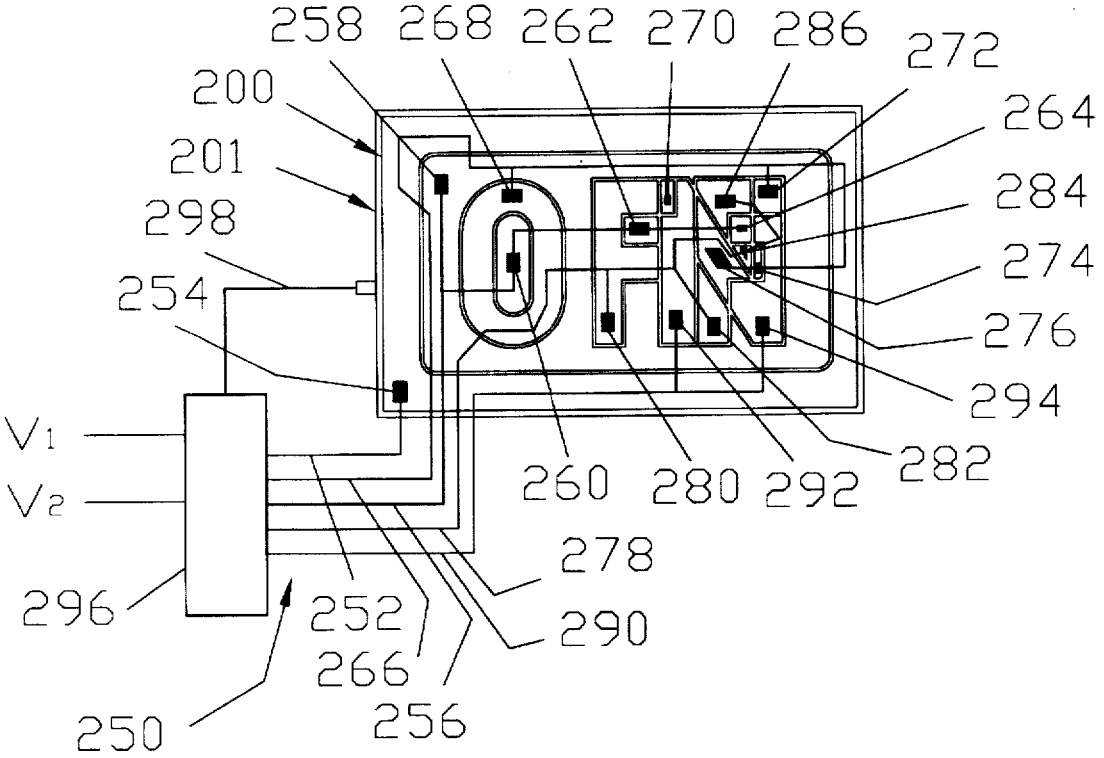
FIG. 11 is the plan view of FIG. 10 onto which are superimposed contacts for the co-planar segments of FIG. 10 as well as a trace of the pattern for the group electrode leads.

The group electrode 200, illustrated in FIGS. 10 and 11, will provide a display which can be toggled to display the words "ON" or "OFF". The group electrode 200 has a first co-planar segment 202 which forms a border area for the display. A second co-planar segment 204 provides a background pattern for the remaining electrode segments which can be selectively energized to provide a display of the words, "OFF" and "ON". A third co-planar segment 206 forms the outline for an "O" while a fourth co-planar segment 208 serves to form the center of the "O". A fifth co-planar segment 210 forms a vertical segment 212 having a top cross-member 216 and a middle cross-member 218 of a first "F" (the left "F" in FIG. 10). A sixth co-planar segment 214 serves to exclude the area between the top cross-member 216 and the middle cross-member 218 of the first "F". A seventh co-planar segment 220 forming an extension of the top cross-member 216 of the first "F" completes the first "F". The seventh co-planar segment 220 also serves as a portion of a left upright 222 of the "N", with the remainder of the upright 122 being formed by an eighth co-planar segment 224. A second "F" (the right "F" in FIG. 10) is formed by a ninth co-planar segment 226, a tenth co-planar segment 228, an eleventh co-planar segment 230, a twelfth co-planar segment 232, a thirteenth co-planar segment 234, and a fourteenth co-planar segment 236. A fifteenth co-planar segment 238 serves to exclude the area between the two cross-members of the second "F". The diagonal element and right upright of the "N" are formed by the tenth co-planar segment 228, the twelfth co-planar segment 232, the fourteenth co-planar segment 236 in combination with a sixteenth co-planar segment 240. This array of co-planar segments, described above, forms a substantially continuous footprint so that all leads connecting the electrodes will be shielded by the co-planar segments. The only unshielded areas are the inter-segment gaps between adjacent co-planar segments such as the gap g between the second co-planar segment 204 and the third co-planar segment 206.

As discussed earlier with regard to other embodiments, the displays, in addition to the group electrode 200, have a first electrode spaced apart from the group electrode 200. In the present embodiment, as with the earlier discussed embodiments, the group electrode 200 is spaced apart from the first electrode 201 which is preferably transparent. In between the first electrode 201 and the group electrode 200 is a phosphor layer which will emit light when subjected to a potential field.

FIG. 11 illustrates the configuration of group electrode leads 250 superimposed on the co-planar segments of the group electrode 200. A first group electrode lead 252 connects to a first pad 254 located on the first co-planar segment 202. A second group electrode lead 256 connects to a second pad 258 which is located on the second co-planar segment 204, a third pad 260 located on the fourth co-planar segment 208, a fourth pad 262 located on the sixth co-planar segment 214 and a fifth pad 264 located on the fifteenth co-planar segment 238. The second group electrode lead 256 being so connected allows the internal areas of the letter to be excluded when either of the words "OFF" or "ON" is displayed. Having electrodes in these areas assures that any group lead passing therebehind will be shielded and allows the polarity of all areas of the screen to be reversed thereby reversing the contrast of the resultant display.

A third group electrode lead 266 is connected to a sixth pad 268 located on the third co-planar segment 206, a seventh pad 270 located on the seventh co-planar segment 220, an eighth pad 272 located on the twelfth co-planar segment 232, a ninth pad 274 located on the fourteenth co-planar segment 236, and a tenth pad 276 located on the tenth co-planar segment 228. The third group electrode lead 266 connects those co-planar segments of the group electrode 200 which are common to both the words "OFF" and "ON".

A fourth group electrode lead 278 is connected to an eleventh pad 280 which is located on the fifth co-planar segment 210, a twelfth pad 282 which is located on the eleventh co-planar segment 230, a thirteenth pad 284 which is located on the thirteenth co-planar segment 234, and a fourteenth pad 286 located on the ninth co-planar segment 226. The fourth group electrode lead 278 connects the remaining co-planar segments of the group electrode 200 needed to form the word "OFF".

A fifth group electrode lead 290 is connected to a fifteenth pad 292 which is located on the eighth co-planar segment 224 and a sixteenth pad 294 which is located on the sixteenth co-planar segment 240. The fifth group electrode lead 290 connects the remaining co-planar segments of the group electrode 200 which, when combined with the electrodes connected by the third group electrode lead 266, form the word "ON".

To operate the display, the group electrode leads 250 are connected to a switch 296 which selectively toggles the group electrode leads 250 between a first voltage $V_1$ and a second voltage $V_2$. The first electrode 201 is also connected to the switch 296 by a first electrode lead 298.

Figure 12:
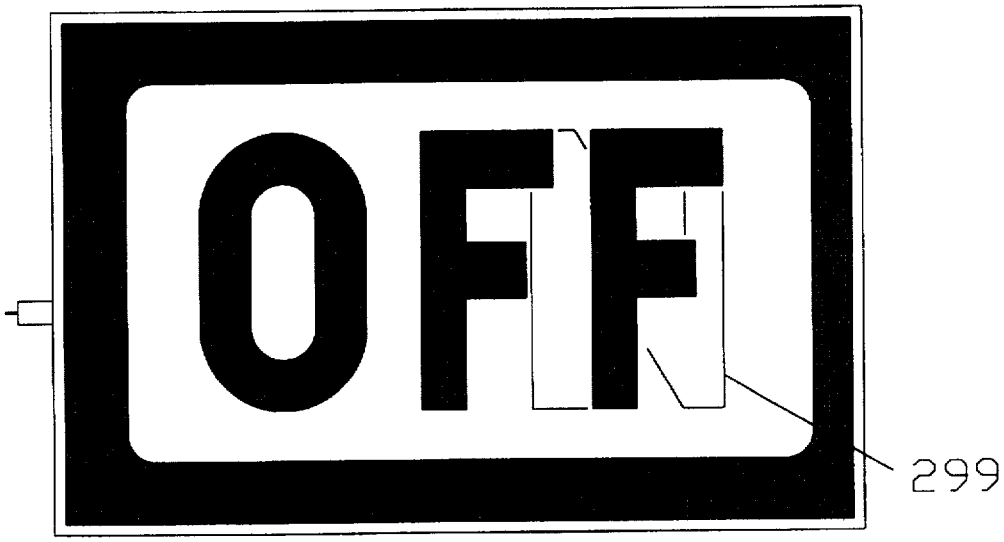
FIG. 12 is a first pattern which can be generated by a display employing the group electrode of FIG. 10.

When the switch 296 maintains the leads 298, 252, 278 and 266 at $V_1$, while maintaining the leads 256 and 290 at $V_2$, the display as illustrated in FIG. 12 results. Dark traces 299 result from the inter-segment gaps between the segments in the group electrode 200 which cause breaks in the field. If the inter-segment gaps are sufficiently narrow, then the dark traces 299 will not appear.

Figure 13:
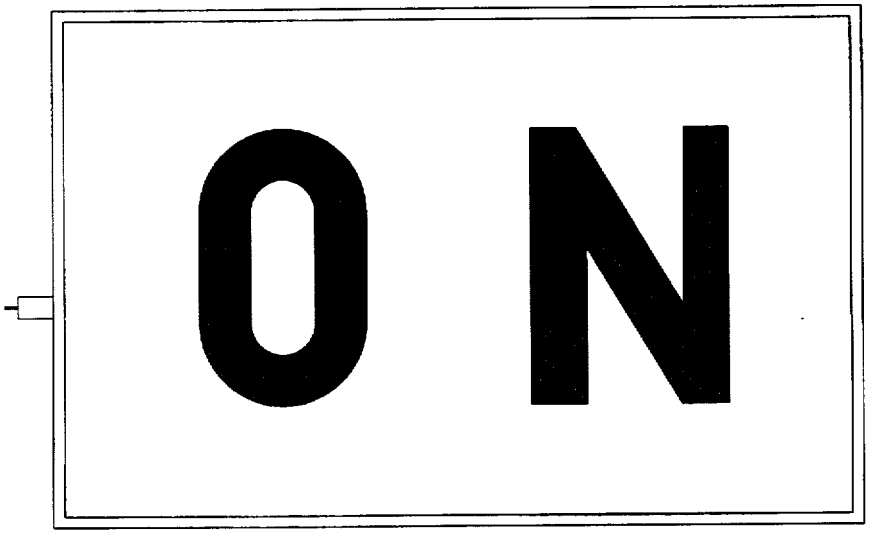
FIG. 13 is a second pattern which can be generated by a display employing the group electrode of FIG. 10.

FIG. 13 illustrates the case when the leads 298, 266 and 290 are maintained at $V_1$ while the leads 252 and 256 are maintained at $V_2$. In this illustration, it is assumed that the inter-segment gaps are sufficiently small to avoid the dark traces 299 shown in FIG. 12.

Figure 14:
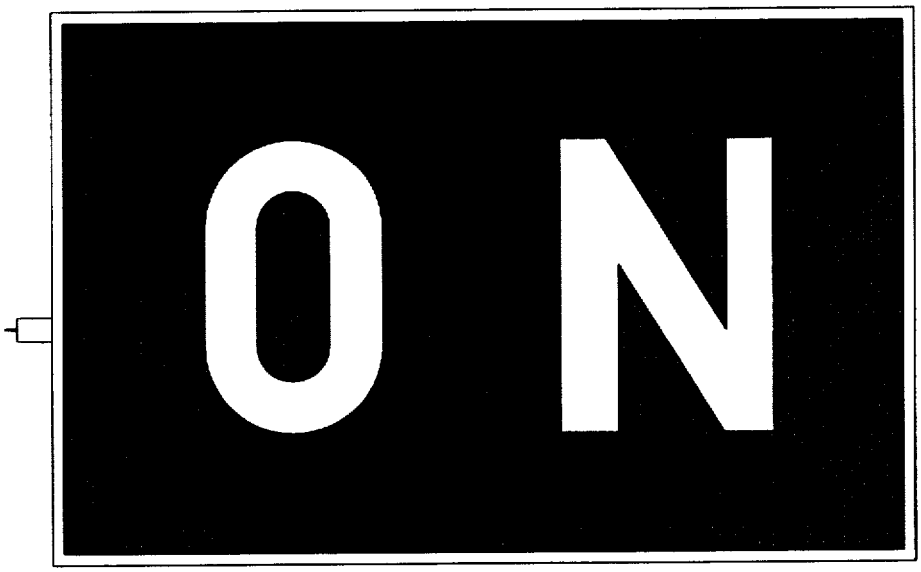
FIG. 14 is a third pattern which can be generated by a display employing the group electrode of FIG. 10.

FIG. 14 illustrates the case where the switch 296 maintains the leads 298, 278 and 256 at $V_1$ and maintains the leads 252, 266 and 290 at $V_2$. The residual ghost images (such as 87, 87' and 87" illustrated in FIGS. 3 and 4) have not been shown, it being assumed that the width of the inter-segment gaps is less than about 20 mils, in which case the residual ghost images would not be apparent in daylight, and more preferably less than 10 mils so that the ghost images would be apparent only in dim light.

Figure 15:
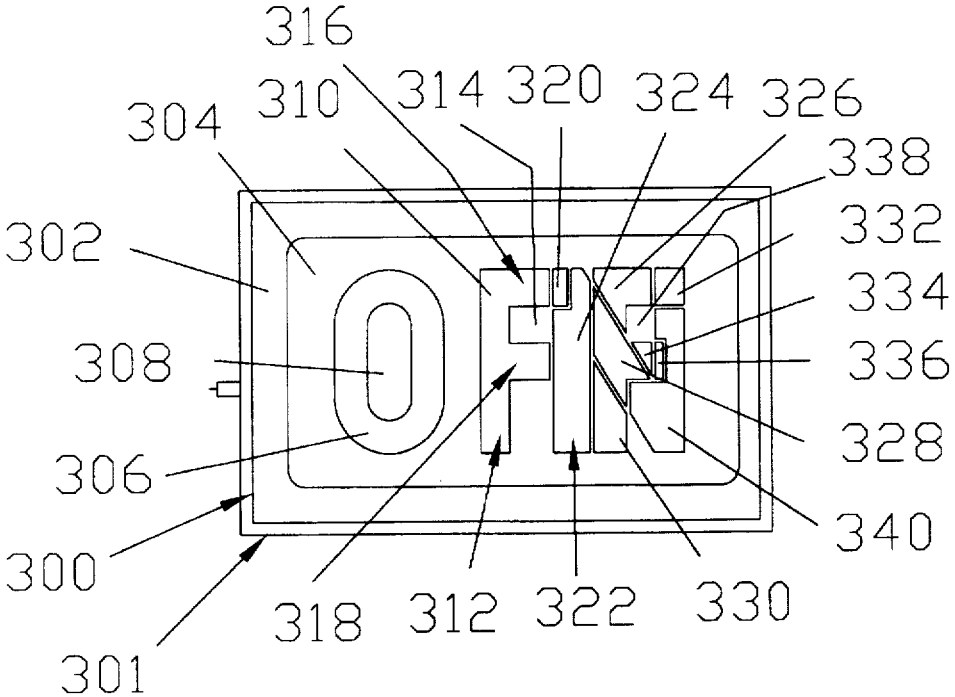
FIG. 15 is a plan view of a modification of the group electrode of the display of FIG. 10. In this embodiment, the footprint on the first electrode is not substantially continuous. When leads are attached to the electrodes of this embodiment, since the group electrode footprint is not substantially continuous, a portion of the leads will fall outside of the footprint, resulting in ghost images.

FIG. 15 is similar to FIG. 10 with the exception that the co-planar segments of a group electrode 300, when projected onto a first electrode 301, do not form a substantially continuous group electrode footprint. (The segments 204, 208, 214 and 238 of the group electrode of FIGS. 10 and 11 have been eliminated in the group electrode illustrated in FIGS. 15 and 16). For purposes of discussion, the open regions where electrodes have been deleted will be referred to with the same numbers as the electrode segments they replace, indexed by 100, and will be referred to as "regions" rather than "segments". All other numbers will also be indexed by 100. In FIG. 15, the group electrode 300 has a first co-planar segment 302 which forms a border area of the display. A second co-planar region 304 of the group electrode 300 serves as a background for the remaining electrode segments which allow the words "OFF" and "ON" to be displayed. A third co-planar segment 306 forms the "O", while a fourth co-planar region 308 forms the center of the "O". A fifth co-planar segment 310 forms a vertical segment 312 of a first "F". A sixth co-planar region 314 is electrode-free, thereby isolating a top cross-member 316 and a bottom cross-member 318 of the first "F". A seventh co-planar segment 320 forms the remainder of the top cross-member 316 of the first "F". The seventh co-planar segment 320 also serves as a portion of a left upright 322 of the "N" with the remainder of the left upright 322 being formed by an eighth co-planar segment 324. A second "F" is formed by a ninth co-planar segment 326, a tenth co-planar segment 328, an eleventh co-planar segment 330, a twelfth co-planar segment 332, a thirteenth co-planar segment 334 and a fourteenth co-planar segment 336. A fifteenth co-planar region 338 is electrode-free and serves to isolate the area between the two cross-members of the second "F". The diagonal element and right upright of the "N" are formed by the combination of the tenth co-planar segment 328, the twelfth co-planar segment 332, the fourteenth co-planar segment 336, and a sixteenth co-planar segment 340. Since this array of segments depicted in FIG. 15 does not form a substantially continuous footprint, not all electrode leads connecting the segments will be shielded by the co-planar segments.

Figure 16:
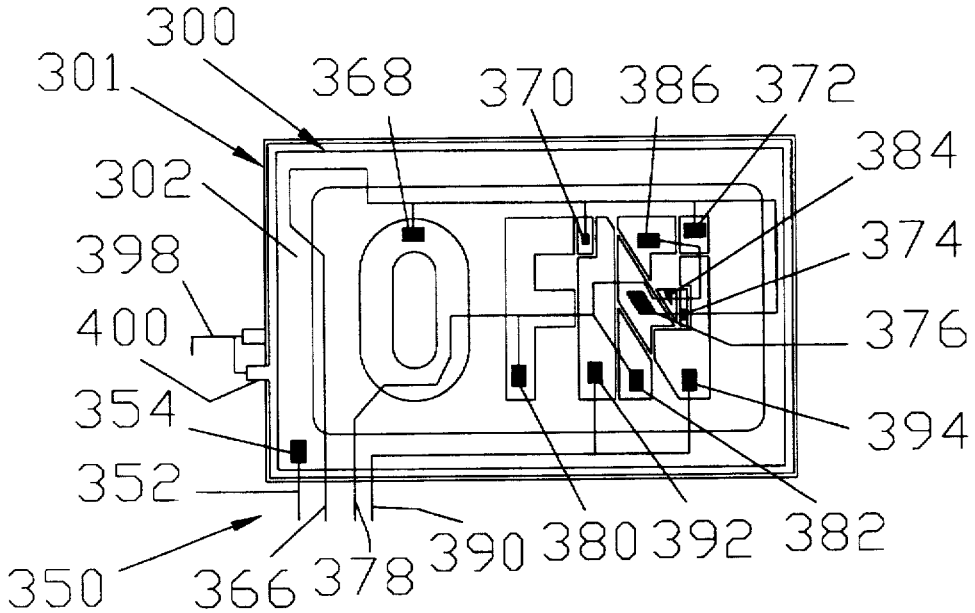
FIG. 16 is the plan view of FIG. 15 onto which are superimposed the contacts for the co-planar segments of FIG. 15. A trace of a back electrode is superimposed on the co-planar segments of the group electrode as is a trace of the group electrode leads. The back electrode provided in this embodiment will prevent ghost images from the electrode leads.

FIG. 16 illustrates the configuration of leads 350 superimposed on the co-planar segments of the group electrode 300. The numbers will parallel the numbers used for FIG. 11 but will be indexed by 100, the numbers being omitted for elements not included in the embodiment of FIG. 16. A first group electrode lead 352 is connected to a first pad 354 located on the first co-planar segment 302. The regions 304, 308, 314 and 338 for this embodiment have no electrode leads associated with them, and therefor will always remain dark.

Figure 17:
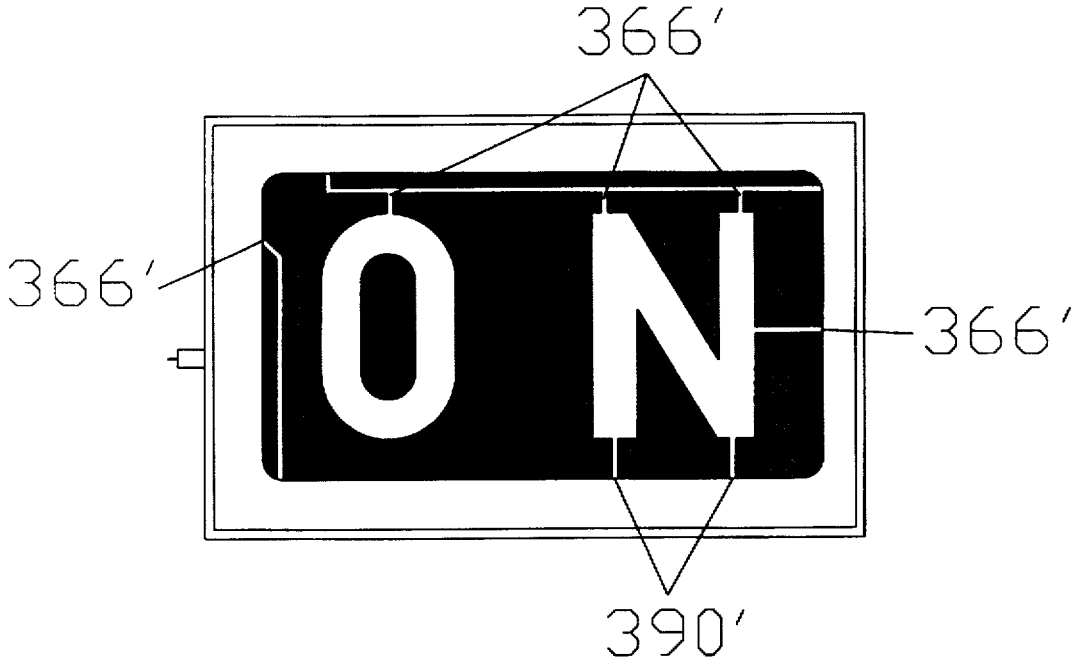
FIG. 17 illustrates one of the patterns which will be generated for a display having the group electrode illustrated in FIG. 15.

A second group electrode lead 366 is connected to a sixth pad 368 located on the third co-planar segment 306, a seventh pad 370, located on the seventh co-planar segment 320, an eighth pad 372 located on the twelfth co-planar segment 332, a ninth pad 374 located on the fourteenth co-planar segment 336, and a tenth pad 376 located on the tenth co-planar segment 328. The second group electrode lead 366 connects those co-planar segments of the group electrode 300 which are common to both the words "OFF" and "ON". When the second group electrode lead 366 is maintained at a potential which differs from the potential of the first electrode 301, traces 366' will be visible in the regions (304, 308, 314 and 338) and will appear in bright field as illustrated in FIG. 17 when the display is generating an "ON" message.

A third group electrode lead 378 is connected to an eleventh pad 380 which is located on the fifth co-planar segment 310, a twelfth pad 382 which is located on an eleventh co-planar segment 330, a thirteenth pad 384 which is located on the thirteenth co-planar segment 334, and a fourteenth pad 386 located on the ninth co-planar segment 326. The third group electrode lead 378 connects the remaining co-planar segments of the group electrode 300 needed to display the word "OFF".

A fourth group electrode lead 390 is connected to a fifteenth pad 392 which is located on the eighth co-planar segment 324 and a sixteenth pad 394 which is located on the sixteenth co-planar segment 340.

The fourth group electrode lead 390 connects the remaining co-planar segments of the group electrode 300 which, when combined with the co-planar segments connected by the second group electrode lead 366, form the word "ON".

A first electrode lead 398 is connected to the first electrode 301 which is spaced apart from the first group electrode 300 and has a phosphor layer therebelow.

When the display with the group electrode 300, having the electrode configuration illustrated in FIG. 15, is connected to a switch such that when leads 398 and 378 are maintained at $V_1$ and leads 352, 366, and 390 are maintained at $V_2$, an image similar to FIG. 14 will result as illustrated in FIG. 17. There will be traces 366' and 390' in the region 304 over which the second group electrode lead 366 and the fourth group electrode lead 390 pass.

To eliminate such traces, a back electrode 400 is provided which is intermediate between the co-planar segments and the group electrode leads. This back electrode 400 functions similarly to the back electrode 122 of the embodiment illustrated in FIGS. 8 and 9. However, in this embodiment the use of the back electrode 400 provides greater utility since the co-planar segments need not form a substantially continuous footprint on the phosphor layer.

The back electrode 400 is electrically connected to the first electrode 301 and assures that there is no potential across the regions 304, 308, 314, and 338, thereby shielding these areas from fields from the leads 366 and 390.

Figure 18:
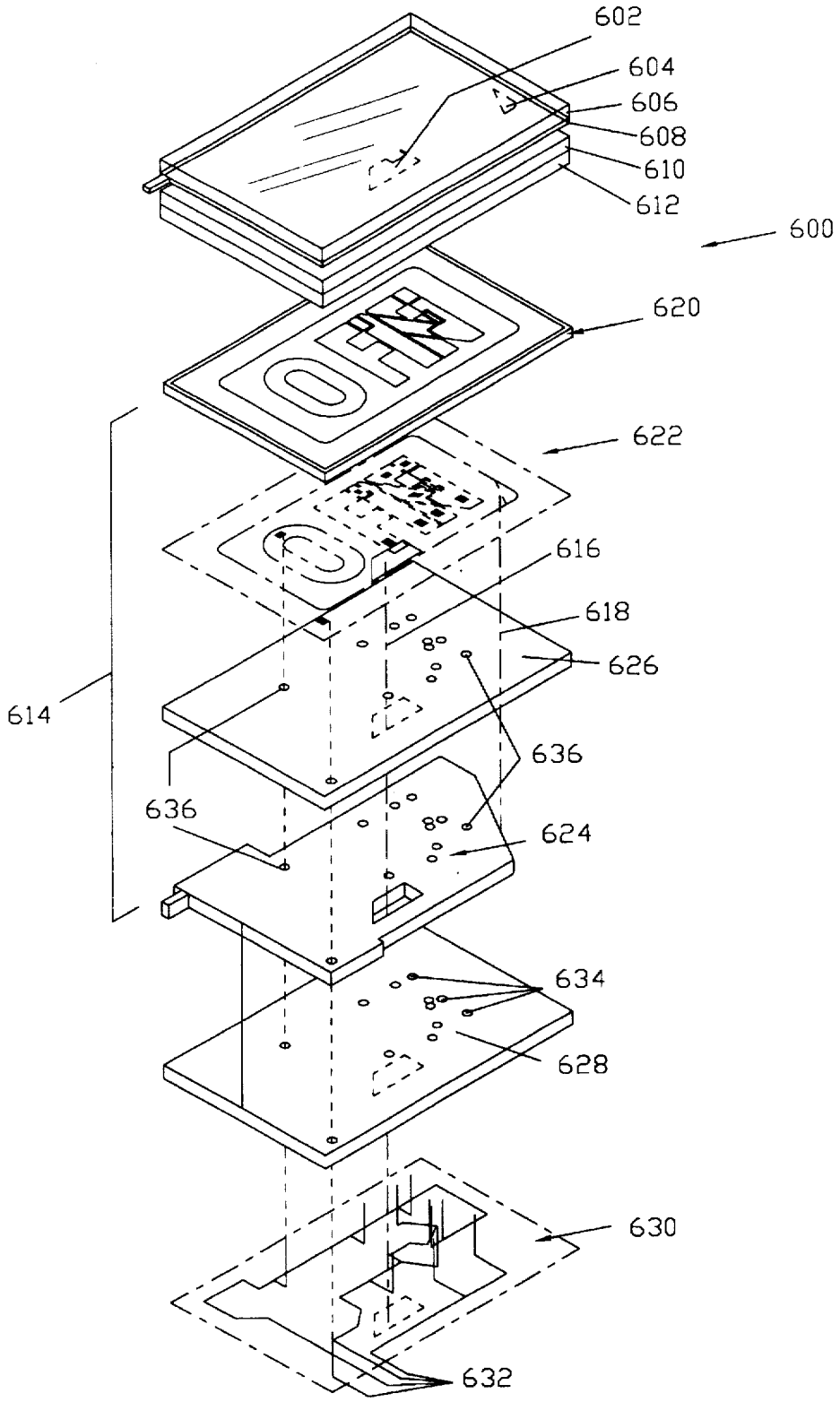
FIG. 18 is an exploded isometric view of a display employing the co-planar segments of FIG. 15 and a back electrode similar to that of FIG. 16, differing in that the back electrode has an opening therethrough. The resulting footprint of the group electrode is continuous, but has an open region. The group electrode leads are so distributed as to assure that the leads project onto the continuous footprint and are excluded from the open region of the group electrode to prevent ghost images.

FIG. 18 is an exploded isometric view of a display 600 which employs a group electrode configuration similar to the group electrode configuration of FIG. 16. In this embodiment, the elements of the group electrode are configured to provide a continuous footprint which does not cover the cross section of the display but rather provides a first open region 602 and a second open region 604. The display 600 has a transparent substrate 606, and a first electrode 608 which is transparent and deposited thereon. A phosphor layer 610 is deposited onto the first electrode 608, and deposited onto the phosphor layer 610 is a dielectric layer 612. A group electrode 614 resides below the dielectric layer 612. While the group electrode 614 is continuous, it does provide a first line of sight 616 and a second line of sight 618 therethrough. These lines of sight (616 and 618) result respectively from the open regions (602 and 604) in the footprint projected onto the first electrode 608. The group electrode 614 has an array of co-planar segments 620 which is deposited onto the dielectric layer 612 and has an array of electrode pads 622 deposited onto the array of co-planar segments 620. The group electrode 614 also has a back electrode 624 which is connected to the first electrode 608 and is spaced apart from the array of co-planar segments 620 by an intermediate insulating layer 626. Although the back electrode 624 is shown as being a single section, multiple back electrode sections which can be electrically connected to the first electrode 608 or, alternatively, to each other could be employed to provide the back electrode 624.

Overlaying the group electrode 614 is a group electrode insulating layer 628. A wiring layer 630 is deposited onto the group electrode insulating layer 628. The wiring layer 630 has a series of group electrode leads 632 which connect to the array of electrode pads 622. The group electrode insulating layer 628 is provided with group electrode lead passages 634 therethrough. The group electrode lead passages 634 provide passages for the group electrode leads 632 which extend through vias 636. The vias 636 pass through the back electrode 624 and the intermediate insulating layer 626 thereby allowing the group electrode leads 632 to connect to the array of electrode pads 622.

The array of co-planar segments 620 and the back electrode 624 form a continuous footprint which, when projected upon the first electrode 608, masks any fields from the wiring layer 630. The wiring layer 630 is distributed so as to avoid passing over the open regions (602 and 604), thereby assuring a ghost-free display.

While the novel features of the present invention have been described in terms of particular embodiments and preferred applications, it should be appreciated by one skilled in the art that substitution of materials and modification of details obviously can be made without departing from the spirit of the invention.

What I claim is:

1. A thick film addressable electroluminescent display comprising:

a polymer film substrate;

a first electrode deposited onto said polymer film substrate;

a phosphor layer deposited onto said first electrode;

a group electrode having, segments, said segments being spaced apart from said first electrode and said substrate to accommodate said phosphor layer, a back electrode having at least one back electrode section, said back electrode being spaced apart from said segments, an intermediate insulating layer interposed between said back electrode and said segments, said segments and said back electrode forming a substantially continuous group electrode footprint;

vias passing through said back electrode and said intermediate insulating layer, said vias extending to said segments;

a group electrode insulating layer deposited onto said group electrode and spaced apart from said polymer film substrate, said group electrode insulating layer having group electrode lead passages therethrough communicating with said vias and said back electrode; and group electrode leads deposited onto said group electrode insulating layer and spaced apart from said polymer film substrate, said group electrode leads being positioned such that said group electrode leads project onto said substantially continuous group electrode footprint, and said group electrode leads passing through said group electrode lead passages and contacting said group electrode.

2. The thick film addressable electroluminescent display of claim 1 further comprising:

a dielectric layer interposed between said phosphor layer and said group electrode.

3. The thick film addressable electroluminescent display of claim 2 wherein said first electrode is transparent.

4. A thick film addressable electroluminescent display comprising:

a polymer film substrate;

a first electrode deposited onto said polymer film substrate;

a phosphor layer deposited onto said first electrode;

a group electrode having, segments, said segments being spaced apart from said first electrode and said substrate to accommodate said phosphor layer, a back electrode having at least one back electrode section, said back electrode being spaced apart from said segments, an intermediate insulating layer interposed between said back electrode and said segments, said segments and said back electrode forming a substantially continuous group electrode footprint having at least one open region therein;

vias passing through said back electrode and said intermediate insulating layer, said vias extending to said segments;

a group electrode insulating layer deposited onto said group electrode and spaced apart from said polymer film substrate, said group electrode insulating layer having group electrode lead passages therethrough communicating with said vias and said back electrode; and group electrode leads deposited onto said group electrode insulating layer and spaced apart from said polymer film substrate, said group electrode leads being positioned such that said group electrode leads project onto said substantially continuous group electrode footprint and do not project onto said at least one open region, and said group electrode leads passing through said group electrode lead passages and contacting said group electrode.

5. The thick film addressable electroluminescent display of claim 4 further comprising:

a dielectric layer interposed between said phosphor layer and said group electrode.

6. The thick film addressable electroluminescent display of claim 5 wherein said first electrode is transparent.

* * * * *